US009145019B2

(12) United States Patent
Kueckendahl et al.

(10) Patent No.: US 9,145,019 B2
(45) Date of Patent: Sep. 29, 2015

(54) MONITORING DEVICE AND METHOD FOR MONITORING MARKING ELEMENTS OF A MARKING HEAD

(75) Inventors: Peter Joerg Kueckendahl, Bad Oldesloe (DE); Daniel Joseph Ryan, Sycamore, IL (US)

(73) Assignee: Alltec Angewandte Laserlicht Technologie GMBH, Selmsdorf (DE)

( * ) Notice: Subject to any disclaimer, the term of this patent is extended or adjusted under 35 U.S.C. 154(b) by 0 days.

(21) Appl. No.: 13/977,151

(22) PCT Filed: Dec. 22, 2011

(86) PCT No.: PCT/EP2011/006523

§ 371 (c)(1), (2), (4) Date: Jun. 28, 2013

(87) PCT Pub. No.: WO2012/089328

PCT Pub. Date: Jul. 5, 2012

(65) Prior Publication Data

US 2013/0271522 A1 Oct. 17, 2013

(30) Foreign Application Priority Data

Dec. 30, 2010 (EP) ..... 10016198

(51) Int. Cl.

| | |
|---|---|
| ***B41J 2/46*** | (2006.01) |
| ***B41J 2/45*** | (2006.01) |
| ***B41J 2/21*** | (2006.01) |
| *B41J 29/393* | (2006.01) |

(52) U.S. Cl.

CPC ..... *B41J 29/393* (2013.01); *B41J 2/2142* (2013.01); *B41J 2/2146* (2013.01); *B41J 2/45* (2013.01); *B41J 2/46* (2013.01); *B41J 2029/3935* (2013.01)

(58) Field of Classification Search

USPC ..... 347/129, 130, 225, 233, 238

See application file for complete search history.

(56) References Cited

U.S. PATENT DOCUMENTS

| | | | |
|---|---|---|---|
| 4,707,063 | A | 11/1987 | Plummer |
| 5,399,032 | A | 3/1995 | Itoh et al. |
| 5,477,259 | A | 12/1995 | Iwasa |
| 5,777,634 | A | 7/1998 | Okamura et al. |
| 5,784,098 | A | 7/1998 | Shoji et al. |
| 6,189,991 | B1 | 2/2001 | Wen et al. |

(Continued)

FOREIGN PATENT DOCUMENTS

| | | |
|---|---|---|
| DE | 2401322 | 1/1974 |
| DE | 3826113 A1 | 2/1989 |

(Continued)

OTHER PUBLICATIONS

Computer-generated translation of JP 2007-090814, published on Apr. 2007.*

(Continued)

*Primary Examiner* — Huan Tran

(74) *Attorney, Agent, or Firm* — Hoffman Warnick LLC

(57) ABSTRACT

The invention relates to a monitoring device for monitoring marking elements of a marking head. The inventive device is characterized in that it comprises a detector for recording detected information on the marking elements, and a control and evaluation unit that is adapted to determine whether the marking elements carry out marking operations based on the detected information. The invention further relates to a method for monitoring marking elements of a marking head.

15 Claims, 3 Drawing Sheets

(56) References Cited

U.S. PATENT DOCUMENTS

| | | | | |
|---|---|---|---|---|
| 6,286,927 | B1 | 9/2001 | Taneya et al. | |
| 6,381,377 | B1 | 4/2002 | Wang | |
| 6,469,729 | B1 | 10/2002 | Ryan | |
| 6,738,086 | B2 | 5/2004 | Oka | |
| 6,855,921 | B1 | 2/2005 | Stopperan et al. | |
| 7,354,130 | B2 | 4/2008 | Arakawa | |
| 7,448,719 | B1 | 11/2008 | Newell | |
| 7,564,020 | B2 | 7/2009 | Sergyeyenko | |
| 7,671,337 | B1 | 3/2010 | Tidwell | |
| 7,908,968 | B2 | 3/2011 | McCoin et al. | |
| 2002/0001004 | A1 | 1/2002 | Mantell et al. | |
| 2002/0101469 | A1 | 8/2002 | Wade et al. | |
| 2002/0109741 | A1 | 8/2002 | Okabe et al. | |
| 2002/0139273 | A1 | 10/2002 | Murata et al. | |
| 2002/0191069 | A1 | 12/2002 | Oka | |
| 2003/0016348 | A1 | 1/2003 | Sallee | |
| 2003/0210861 | A1 | 11/2003 | Weiss et al. | |
| 2003/0235373 | A1 | 12/2003 | Ishii et al. | |
| 2004/0160478 | A1 | 8/2004 | Weijkamp et al. | |
| 2005/0122548 | A1 | 6/2005 | Cunnigan et al. | |
| 2005/0123303 | A1* | 6/2005 | Guttman et al. | 398/142 |
| 2005/0140770 | A1 | 6/2005 | Kang et al. | |
| 2005/0286093 | A1 | 12/2005 | Sumi et al. | |
| 2006/0066924 | A1* | 3/2006 | Delueg | 358/506 |
| 2006/0109525 | A1 | 5/2006 | Evans | |
| 2007/0091132 | A1 | 4/2007 | Lim | |
| 2007/0279713 | A1 | 12/2007 | Feng et al. | |
| 2008/0055352 | A1 | 3/2008 | Toh et al. | |
| 2008/0246962 | A1 | 10/2008 | Yang | |
| 2010/0002057 | A1 | 1/2010 | Hatasa et al. | |
| 2010/0102032 | A1 | 4/2010 | Bathelet | |
| 2010/0214387 | A1 | 8/2010 | Fox et al. | |
| 2010/0231929 | A1 | 9/2010 | Kakigi | |
| 2013/0021398 | A1 | 1/2013 | Mizes et al. | |
| 2013/0286147 | A1 | 10/2013 | Kueckendahl et al. | |
| 2013/0286148 | A1* | 10/2013 | Kueckendahl et al. | 347/225 |
| 2013/0286149 | A1 | 10/2013 | Kueckendahl et al. | |
| 2013/0293658 | A1 | 11/2013 | Kueckendahl et al. | |
| 2013/0328978 | A1 | 12/2013 | Sekino et al. | |
| 2013/0342823 | A1 | 12/2013 | Kueckendahl et al. | |

FOREIGN PATENT DOCUMENTS

| | | | | |
|---|---|---|---|---|
| EP | 0121369 | A2 | 10/1984 | |
| EP | 0832754 | B1 | 12/1993 | |
| EP | 0832752 | A2 | 4/1998 | |
| EP | 1266763 | A1 | 12/2002 | |
| EP | 1640169 | A3 | 9/2005 | |
| EP | 1640169 | * | 3/2006 | B41J 2/46 |
| EP | 1640169 | A2 | 3/2006 | |
| EP | 1640169 | A3 | 10/2007 | |
| EP | 2105309 | A1 | 9/2009 | |
| JP | 59136267 | | 8/1984 | |
| JP | 05185686 | | 7/1993 | |
| JP | 2001332806 | A | 11/2001 | |
| JP | 2007090814 | * | 4/2007 | B41J 2/44 |
| JP | 2007090814 | A | 4/2007 | |
| JP | 2008126471 | A | 6/2008 | |
| JP | 2009037128 | A | 2/2009 | |
| WO | 8505187 | | 11/1985 | |
| WO | 8505187 | A1 | 11/1985 | |
| WO | 2006037973 | A1 | 4/2006 | |
| WO | 2007107030 | A1 | 9/2007 | |
| WO | 2008104222 | A1 | 9/2008 | |
| WO | 2009153795 | A1 | 12/2009 | |

OTHER PUBLICATIONS

International Preliminary Report On Patentability for PCT/EP2011/006523, issued on Jul. 2, 2013.*

International Application No. PCT/EP2011/00652023, Written Opinion of International Search Authority.

U.S. Appl. No. 13/976,779, Office Action dated Jun. 16, 2014, 13 pages.

U.S. Appl. No. 13/977,156, Final Office Action dated Dec. 5, 2014, 13 pages.

U.S. Appl. No. 13/976,793, Notice of Allowance dated Dec. 9, 2014, 66 pages.

International Application No. PCT/EP2011/006514, Written Opinion of International Search Authority.

International Application No. PCT/EP2011/006518, Written Opinion of International Search Authority.

International Application No. PCT/EP2011/006515, International Preliminary Report on Patentability, Jan. 21, 2013.

International Application No. PCT/EP2011/006515, Written Opinion on Search Report.

International Application No. PCT/EP2011/006521, Written Opinion of International Search Authority.

International Application No. PCT/EP2011/006521, Written Opinion of International Examining Authority.

International Application No. PCT/EP2011/006516, Written Opinion of International Search Authority.

International Application No. PCT/EP2011/006520, Written Opinion of International Search Authority.

International Application No. PCT/EP2011/006516, International Search Report, dated Mar. 23, 2012, 3 pages.

U.S. Appl. No. 13/976,814, Notice of Allowance Dated Dec. 29, 2014, 10 pages.

International Application No. PCT/EP2011/006522, Written Opinion of International Search Authority.

International Application No. PCT/EP2011/006522, International Report on Patentability.

International Application No. PCT/EP2011/006517, Written Opinion of International Search Authority.

International Application No. PCT/EP2011/006519, Written Opinion of International Search Authority.

International Application No. PCT/EP2011/006519, Preliminary Report on Patentability.

U.S. Appl. No. 13/976,804, Office Action dated Jul. 8, 2014.

U.S. Appl. No. 13/976,804, Notice of Allowance dated Mar. 20, 2014.

U.S. Appl. No. 13/976,809, Office Action dated May 27, 2014.

U.S. Appl. No. 13/977,159, Office Action dated Jun. 20, 2014.

U.S. Appl. No. 13/976,832, Notice of Allowance and Fees Due dated Jun. 24, 2014.

U.S. Appl. No. 13/976,793, Office Action dated Jul. 1, 2014.

U.S. Appl. No. 13/977,151, Notice of Allowance and Fees Due dated Aug. 4, 2014.

U.S. Appl. No. 13/977,156, Office Action dated Jul. 9, 2014.

U.S. Appl. No. 13/976,832, Notice of Allowance and Fees Due dated Oct. 8, 2014.

U.S. Appl. No. 13/976,814, Notice of Allowance and Fees Due dated Oct. 21, 2014.

U.S. Appl. No. 13/976,804, Office Action dated Oct. 24, 2014.

U.S. Appl. No. 13/976,779, Notice of Allowance and Fees Due dated Oct. 21, 2014.

U.S. Appl. No. 13/977,159, Office Action dated Oct. 10, 2014.

U.S. Appl. No. 13/976,804, Notice of Allowance dated Apr. 30, 2015, 55 pgs.

U.S. Appl. No. 13/976,804, Notice of Allowance, Feb. 3, 2015, 18 pages.

U.S. Appl. No. 13/976,793, Notice of Allowance, Feb. 4, 2015, 16 pages.

U.S. Appl. No. 13/976,779, Notice of Allowance, Feb. 6, 2015, 18 pages.

U.S. Appl. No. 13/976,809, Office Action, Feb. 6, 2015, 78 pages.

U.S. Appl. No. 13/977,159, Notice of Allowance, Feb. 17, 2015, 15 pages.

U.S. Appl. No. 13/977,156, Notice of Allowance dated Mar. 16, 2015, 21 pgs.

* cited by examiner

MONITORING DEVICE AND METHOD FOR MONITORING MARKING ELEMENTS OF A MARKING HEAD

FIELD OF THE INVENTION

The present invention relates in a first aspect to a monitoring device for monitoring marking elements of a marking head.

In a second aspect, the invention relates to a method for monitoring marking elements of a marking head.

RELATED ART

Marking heads are widely used to apply markings onto an object. The markings can e.g., but not limited to, be laser markings or engravings, laser or LED printings or ink-jet printings.

In particular, the marking head may comprise a plate having a plurality of receiving spaces, each of which housing a marking element. The marking element may comprise a light source and a light guide for guiding marking light emitted by the light source to the receiving space. Knowledge of which light source is connected to which receiving space, or, in other words, knowledge of the position of a marking element is thus required.

Conventionally, to this end personnel take great care in manually connecting the light sources to the receiving spaces. However, this is very time consuming and, nevertheless, wrong connections cannot be ruled out for sure.

Another problem arises from the desire to ever increase the number of marking elements for the purpose of higher marking speed and improved resolution. However, while the risk of failure of a single marking element may be very low, a large number of marking elements still frequently leads to malfunctions. A defective marking element has then to be replaced. In this case, it may be unknown and thus has to be determined which marking element is the defective one.

Therefore, it may be considered as another general problem to identify defective marking elements.

SUMMARY OF THE INVENTION

It is an object of the invention to provide a method and a monitoring device that provide for a particularly fast and cost-effective way of monitoring marking elements of a marking head.

This objective is solved with a monitoring device and a method.

Preferred embodiments are given in the dependent claims as well as in the following description, in particular in connection with the attached figures.

According to the invention, the device of the above mentioned kind may be characterized in that a detector for recording detected information on the marking elements is provided, and a control and evaluation unit is provided which is adapted to determine whether the marking elements carry out marking operations based on the detected information.

The method of the above mentioned kind may be, according to the invention, characterized in that the marking elements are activated to carry out a marking operation, detected information on the marking elements is recorded, and it is determined whether a marking element carries out a marking operation based on the detected information.

It can be regarded as an idea of the invention to activate a marking element and simultaneously detect whether the activated marking element carries out a marking operation. If the activated marking element does not perform a marking operation, it may be identified as a defective marking element.

An idea of the invention resides in the fact that an initially unknown position of a marking element may be determined by activating the marking element and detecting a signal originating from a marking operation carried out by the activated marking element.

It can be seen as an advantage of the invention that the monitoring device may be readily mountable to a marking head and thus keeps low maintenance times for monitoring the marking elements.

Additionally, the monitoring device can monitor a marking head regardless of its exact number and position of marking elements. Thus a broad field of application is allowed for.

Generally, it is possible that the detector may be of any kind suited to sense a marking operation or a marking. For instance, but not limited to, the detector may be sensitive to electromagnetic radiation, to temperature changes induced by marking operations or to acoustic waves produced in connection with the marking operations. However, it may be preferred that the detector is a light detector, e.g. a detector sensitive to the visible, the infrared, and/or the ultraviolet regime.

The control and evaluation unit of the invention may be a regular personal computer or laptop. Thus, standard equipment may suffice and no additional hardware to perform the function of the control and evaluation unit may be required.

A marking element which can also be called a marking component may be any device suitable for performing a marking operation, i.e., producing a visible or measurable spot or pixel on an object to be marked. This may be achieved, for instance, by radiating energy in the form of light, e.g. in laser engraving, onto the object. It is also possible to interact with a layer, such as a photosensitive layer, which may have been previously applied to the object, e.g. in laser printing. Additionally, the marking element may be any kind of printing element, such as an inkjet nozzle or a LED or laser light source for laser printing.

The detected information may also be referred to as detection data or a detection signal. It comprises at least enough information to enable the control and evaluation unit to determine whether a marking element carries out a marking operation when activated, or remains idle.

This detected information may be gathered by monitoring the object to be marked, i.e., markings on the object, or preferably by monitoring the operation itself of a marking element. For instance, if the marking element emits marking light during a marking operation, the detector may be adapted to measure this marking light.

According to a preferred embodiment of the invention, the control and evaluation unit is adapted to determine whether a marking element is defective based on the detected information and on activation information about which marking elements were activated when the detected information was recorded. It may thus not only be determined that a marking element is defective but also which marking element is the defective one. Replacement of the defective marking element may thereby be eased significantly.

Another preferred embodiment of the inventive device is adapted to monitor marking heads comprising an array of receiving spaces, and wherein each of the marking elements comprises a light source for emitting marking light used for marking and comprises a light guide connected to the light source and one of the receiving spaces for guiding the marking light from the light source to the receiving space. Such marking heads are e.g., but not limited to, used for laser engraving and/or applying marks on nutrition packages.

Here, according to the invention, the control and evaluation unit may be adapted to determine which light source is connected to which receiving space based on the detected information and on activation information about which marking elements were activated when the detected information was recorded.

In these cases, the light sources may be connected, e.g. manually, to receiving spaces via light guides, that means light wave guides. The light guides may be attached to the respective receiving spaces by means of ferrules.

With the monitoring device of the invention, it is possible to connect light sources with receiving spaces in an arbitrary pattern, resulting in time saving in production. In a subsequent step, the marking elements are activated, e.g. one after another, the detector gathers detected information and the control and evaluation unit builds a mapping table containing information on a pixel order, i.e. information on which light source is connected to which receiving space. Hence, it may not be necessary to keep track of individual light guides and where these are to be inserted.

Additionally or alternatively, if a predefined order or pattern for connection between the light sources and the receiving spaces is demanded, the inventive device may be used for verifying whether that order has been complied with.

According to still another preferred embodiment of the invention, the detector provides for spatially resolved recording of detected information on the marking elements, particularly with a camera. As a camera, a webcam may be sufficient. The spatial resolution may be obtained by providing a detector with a plurality of sensitive elements, e.g. light sensitive elements. Additionally or alternatively, the detector may comprise a movable or rotatable mirror for successively collecting light originating from different locations, thus reducing the number of sensitive elements required.

A preferable embodiment of the inventive device is characterized in that the control and evaluation unit may be adapted for activating the marking elements to carry out marking operations, particularly in a predefined order, preferably one marking element at a time or all marking elements at once.

By activating all marking elements at once, the control and evaluation unit can determine a defective marking element in a time saving manner. That means, the position, e.g. row and column information, of the defective marking element may be identified. However, it is generally possible to activate the marking elements in any arbitrary, predefined order.

As a further advantage, by controlling the activation/deactivation of the marking elements, the control an evaluation unit itself may provide the aforementioned activation information.

Time need for determining whether the marking elements are capable of carrying out marking operations can be reduced if each marking element is activated only once.

According to another embodiment of the invention, a housing for holding the detector in a defined position relative to the marking head is present. By providing a defined position, reproducible measurements may be carried out. Furthermore, the defined position may be chosen such that the housing holds the detector in a distance to the marking elements at which a field of view of the detector is at least as large as an area formed by the marking elements. That means, the detector can detect all marking elements.

According to a preferred embodiment of the invention, the housing is formed to prevent stray light from reaching the detector. To this end, the housing may form a hollow casing with dimensions such that it substantially extends from the detector to the marking head when the monitoring device is in a predefined position for monitoring. The housing may be, for example, in the form of a funnel or a pyramid with the peak of the funnel or pyramid pointing at the detector. A base surface of the housing opposite to a side of the housing facing the detector may be shaped to fit to a plate of the marking head, e.g. a marking head base plate. The base surface of the housing may be formed as a square base for this purpose.

In case that the marking elements are adapted to emit marking light for marking, according to still another preferred embodiment of the invention, an at least semitransparent plate, particularly a diffusor and/or frosted glass, is provided at the housing. By this arrangement, the detector measures marking light scattered by the plate. It may thus be ensured that at least a part of the marking light which is in many cases strongly focused reaches the detector. Furthermore, an excessive intensity of marking light which may harm the detector is reduced by the plate. The semitransparent plate may be arranged at and/or within the housing such that substantially no marking light reaches the detector without passing through the semitransparent plate.

The semitransparent plate, together with the housing, may be formed such that a lens of the detector is enclosed therein and thus protected against particles such as dust.

According to another embodiment of the invention, the semi transparent plate is adapted to visualize a marking operation of a marking element. If the marking element is for example, but not limited to, an inkjet nozzle, the plate may comprise a sheet of paper for receiving an ink droplet from the inkjet nozzle. The detector then detects the location of the ink droplet. To this end, an illumination light source may be provided that illuminates the semi transparent plate, for facilitating the detection of ink droplets on the plate.

According to a preferred embodiment of the invention, the at least partially transparent plate is a phosphorescent or fluorescent plate. This may be advantageous if marking light emitted by the marking elements is in the UV region and thus not detectable with an inexpensive camera as a detector. In the sense of the invention, a phosphorescent or fluorescent plate can be any plate that emits light at longer wave-length than it absorbs, i.e., the plate converts incoming light to longer wavelengths. Hence, UV light emitted by marking elements can be converted to the visible region by the phosphorescent or fluorescent plate and can then be detected with a camera which is sensitive to the visible region.

The plate may also be used to visualize IR light emitted by the marking elements via non-linear processes in the plate, that means a plurality of photons corresponding to IR light may be converted to a single photon corresponding to visible light.

However, as many cameras are sensitive to IR light as well, the plate may comprise a filter for UV and VIS light such that only IR light emitted by the marking elements can reach the camera.

Another preferred embodiment of the invention is characterized in that fixing means for removably fixing the housing to the marking head in a defined relative position is provided. The fixing means may comprise a plurality of magnetic or mechanical locks which allow for fast fixing and release. In one embodiment, only one defined relative position is allowed for. If for instance the marking elements are arranged in a square array, it is thus ensured that the four sides of the array are not confused or mixed up. To this end, the arrangement of magnetic or mechanical locks is not rotationally invariant, in particular not invariant under a rotation of 90 degrees. For example, on each of three sides or edges out of four sides or edges of a surface of the housing facing the marking head there may be provided a lock.

If magnetic locks are used, these may be formed as magnetic switches. Once all switches are closed, it may be provided that the control and evaluation unit automatically starts a measuring procedure, such as a 'pixel order detection mode' and/or a 'defective pixel detection mode' which will be described in connection with the figures.

For enabling the housing to fit to marking heads of different sizes or shapes, it may also be provided that the locks are adjustable in position and/or a plurality of locks are provided at different radial distances, the radial distances being defined with respect to an axis connecting the detector and a central area of the marking head.

It may be preferred that the detector detects a marking operation by directly measuring whether a marking element is active. In case the marking element emits marking light, this means to detect the marking light.

However, it is also possible to detect a marking operation by its result, i.e. detecting whether a marking has been applied to an object. In that case, the monitoring device may be arranged next to the marking head in the advance direction, i.e. the direction of relative movement between an object to be marked and the marking head. A fixed installation of the monitoring device is thus possible. Furthermore, the monitoring device can be operated during a regular operation of the marking head.

The invention also relates to a marking apparatus. This apparatus comprises a marking head and a monitoring device. The marking head and the monitoring device may comprise any features described in connection with the embodiments of the inventive monitoring device.

The marking apparatus and/or the marking head may be equipped with counterparts to the fixing means provided at the housing of the monitoring device. Adjustment and connection of the monitoring device to the marking head at a predefined position can thus be achieved.

A preferable embodiment of the inventive marking apparatus is characterized in that the marking head comprises at least one spare element for marking, the at least one spare element is deactivated as long as all marking elements are functional, and the at least one spare element is displaceable in order to replace a defective marking element. The spare element is thus ready for use, in particular connected to a light source for emitting marking light, and only needs to be positioned at a desired location. This positioning may be carried out manually, i.e. by disconnecting the defective marking element, for example by removing a light guide of the defective marking element from the respective receiving space, and connecting the wave guide of the spare element with the receiving space of the defective marking element to be replaced.

After replacing a defective marking element, the monitoring device may be used for determining which light source is connected to which receiving space.

It may be provided that at least one additional receiving space for receiving the at least one spare element is provided, and the at least one additional receiving space is located outside the array of receiving spaces.

According to a preferred embodiment of the inventive method at least the following steps are carried out in order to detect whether a marking element is defective: the marking elements are activated all at once; detected information on all marking elements is recorded at once; and if one marking element does not carry out a marking operation, this marking element is identified as a defective marking element.

Another preferred embodiment of the invention is characterized in that at least the following steps are carried out for determining an order of the marking elements, i.e. a pixel order:—the marking elements are activated successively;—a position of the respective activated marking element is determined; and—a mapping table comprising the positions of the marking elements is built.

The positions of the marking elements may be expressed by identifying the receiving space that the light source of the marking element is connected to. The mapping table may thus include the row and column number of the respective receiving space to which a light source is connected.

The invention also relates to a method for replacing a defective marking element of a marking head. That method comprises the steps of:—carrying out a method for monitoring marking elements of a marking head and identifying a defective marking element based on the detected information, as described above, and—replacing the defective marking element with a spare element.

A preferable embodiment of the inventive method is characterized in that the replacement of a defective marking element with a spare element is carried out automatically. To this end, the spare element may be movable in a direction transverse to an advance direction between an object to be marked and the marking head. Once a marking element is identified as defective, the spare element is moved by an electromotor into a replacement position. In the replacement position, the spare element is aligned with the defective marking element in the advance direction. That means, in the replacement position, the spare element can apply markings to the same areas of an object as the marking element to be replaced would.

According to still another preferred embodiment of the inventive method, the method steps for determining the pixel order are carried out after automatically replacing a defective marking element. Little time and manual labour may here be required for identifying and replacing a defective marking element.

BRIEF DESCRIPTION OF THE DRAWINGS

The invention is described in greater detail below by reference to preferred embodiments which are illustrated in the attached drawings in which.

DETAILED DESCRIPTION OF THE INVENTION

Equivalent components are referred to in all figures with the same reference signs, respectively.

Figure 1:
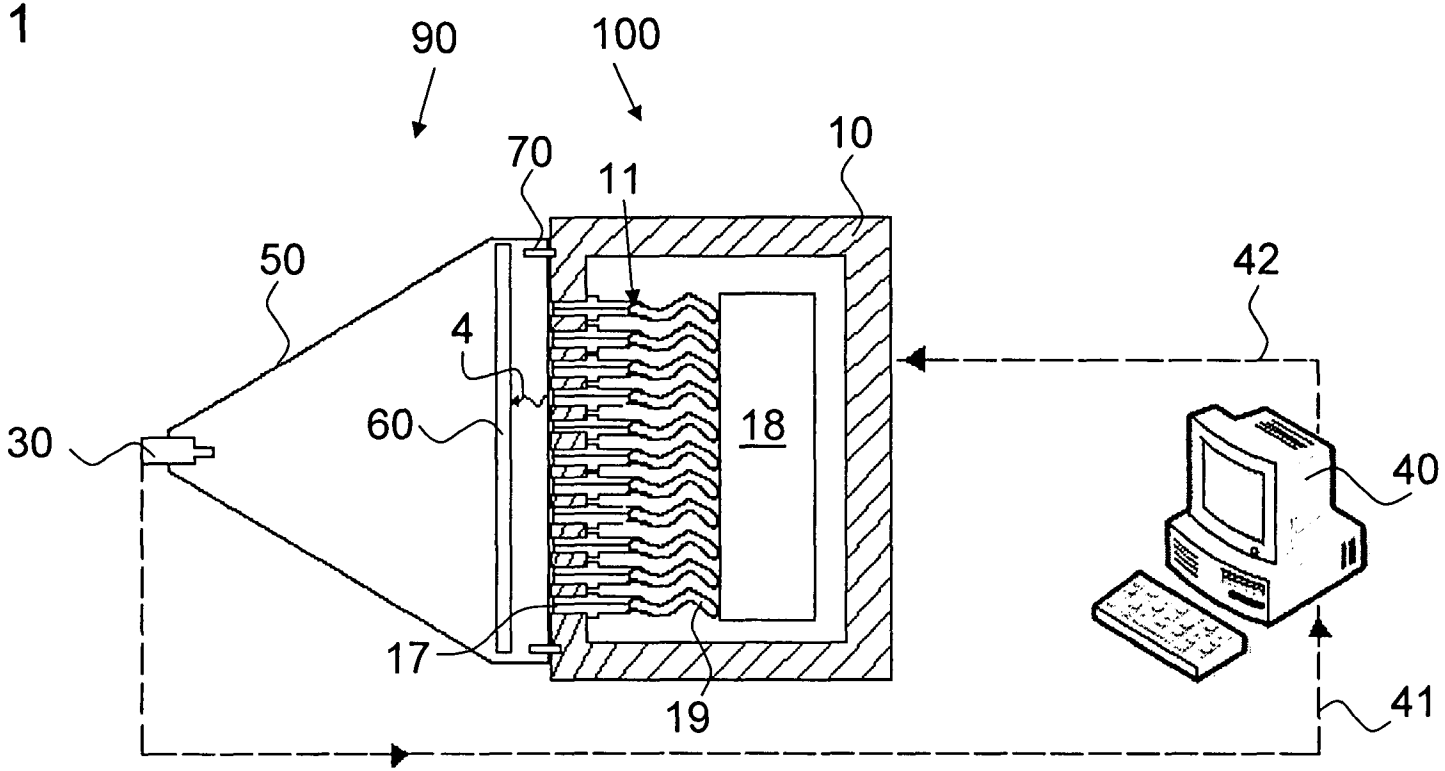
FIG. 1 shows a schematic diagram of a first embodiment of an inventive apparatus and an inventive monitoring device.

FIG. 1 shows a schematic diagram of a first embodiment of a marking apparatus 100 according to the invention and a monitoring device 90 according to the invention.

The monitoring device 90 comprises a detector 30 and a control and evaluation unit 40. The detector 30 and the control and evaluation unit 40 may be low cost equipment, such as a webcam and a personal computer.

The marking apparatus 100 comprises the monitoring device 90 and a marking head 10.

The marking head 10 has a plurality of marking elements 11 for applying markings to an object to be marked (not depicted). To this end, the marking elements 11 may be adapted to emit marking light 4.

It may be provided that the marking head 10 comprises a plate with an array of receiving spaces 17. For the purpose of producing marking light 4, the marking head 10 may comprise light sources 18, each of which being connected to a receiving space 17 via a light guide 19 which may also be referred to as an optical waveguide.

Under normal operation (not shown), an object to be marked is moved along the marking elements 11 such that marking light 4 emitted by the marking elements 11 impinges on the object.

In the situation shown, the monitoring device 90 is located at or attached to the marking head 10. The detector 30 detects whether marking light 4 is emitted by a marking element 11 and transmits this information, the so called detected information, via a connection line 41 to the control and evaluation unit 40. From the detected information, which may also be called a detection signal, the control and evaluation unit 40 determines whether marking light was received by the detector 30.

If the detector 30 has a spatial resolution, i.e. the detector 30 is a camera 30, the control and evaluation unit 40 determines from the detection signal a position of the activated marking element 11. An identification of which marking element 11 is activated may be understood as an equivalent to the position of the activated marking element 11.

It may be provided that the control and evaluation unit 40 controls the marking head 10 via a connection line 42. That means, the control and evaluation unit 40 is adapted to activate and deactivate the light source 18 of each marking element 11.

In a preferred embodiment, the inventive device 90 is adapted to be run in a so called 'pixel order detection mode'. That mode may be advantageous if it is initially unknown which light source 18 is connected to which receiving space 17. This may be the case if the light sources 18 were connected to the receiving spaces 17, e.g. by technical personnel, in an arbitrary, time saving way.

The control and evaluation unit 40 is here adapted to generate a mapping table containing the information to which receiving space each light source 18 is connected, respectively. Tantamount to this table is a mapping table containing an ID of each light source and to which X/Y-position the respective light source is connected, the X/Y-position being a position in the direction of columns and of rows of the array of marking elements.

To this end, the control and evaluation unit 40 activates the light sources 18 one after another. Simultaneously, the detector 30 records the position, that means the receiving space 17, from which marking light 4 is emitted. From the detected information, the control and evaluation unit 40 builds then the mapping table.

In order to ensure a predefined distance between the detector 30 and the marking head 10, a housing 50 may be provided. The housing 50 is connected to the detector 30 and can be detachably fixed to the marking head 10. For this purpose, at least one fixing element, e.g. a magnetic fixing element 70, may be provided. The fixing element 70 which may also be referred to as fixing means ensures that the monitoring device 90 can be attached to the marking head 10 in only one position.

The housing 50 is opaque and substantially encloses the area between the detector 30 and the marking head 10 such that stray light is prevented from reaching the detector 30.

Detection of marking light 4, that means of a marking operation, is facilitated in that a semitransparent plate 60 is provided within the housing 50 and between the detector 30 and the marking head 10.

Marking light 4 impinging onto the plate 60 is scattered and therefore reaches the detector 30 substantially regardless of whether the marking light 4 was emitted by a marking element 11 in a direction other than a direction towards the detector 30.

Figure 2:
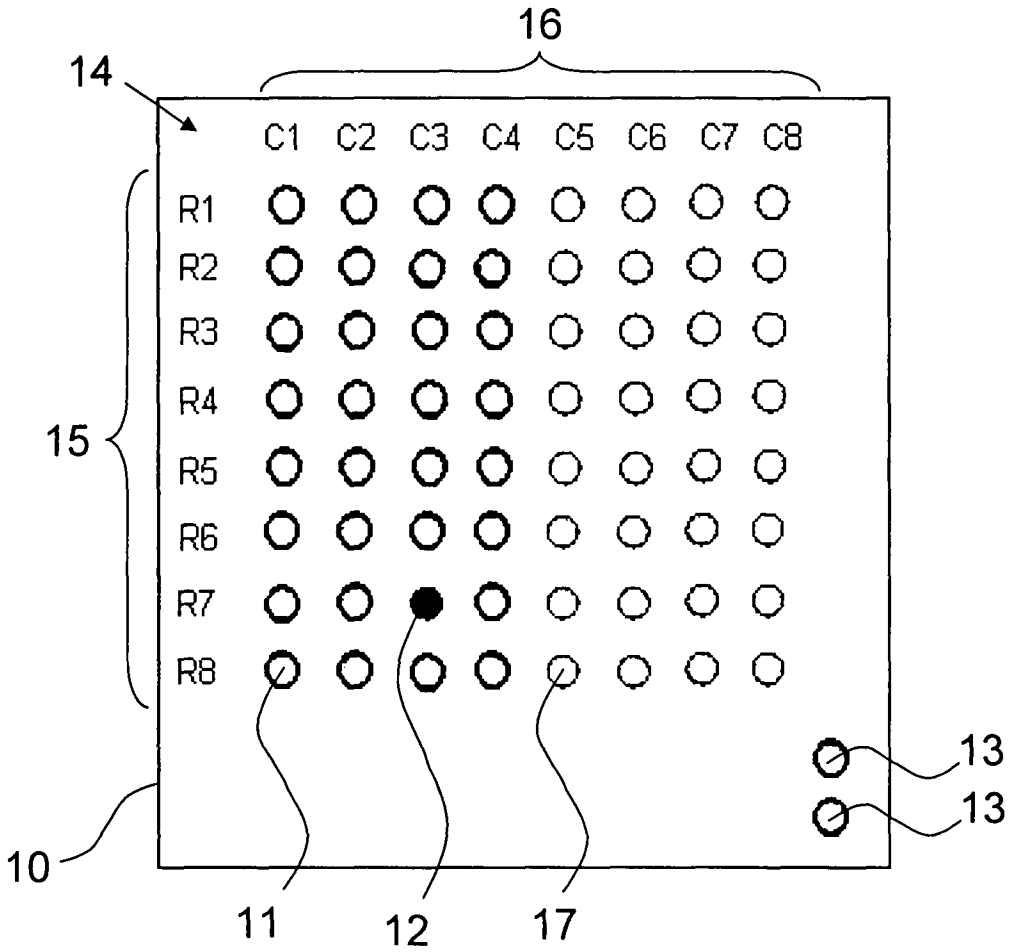
FIG. 2 shows a schematic diagram of an embodiment of a marking head of an apparatus according to the invention.

A schematic representation of a marking head 10 of an embodiment of a monitoring device 90 and a marking apparatus 100 according to the invention is shown in FIG. 2.

The marking head 10 comprises an array 14 of receiving spaces 17 arranged in columns 16 and rows 15. A number of receiving spaces 17 (bold lines) is connected to marking elements 11. As in the example shown, this may be the case for the receiving spaces 17 of the columns 16 designated with C1 to C4 and rows 15 designated with R1 to R8. The remaining receiving spaces 17 (thin lines), i.e. the receiving spaces 17 of the columns 16 designated with C5 to C8, are not used for marking.

Outside the array 14 additional receiving spaces each of which housing one spare element 13 are provided.

A preferred function of the inventive monitoring device and the inventive marking apparatus which may be called a 'defective pixel detection mode' is described in the following. This may be advantageous for service tasks and/or at the end customer who uses a marking head.

In this mode, the control and evaluation unit activates all marking elements 11, preferably at one time. It is, however, also possible to activate the marking elements 11 successively. This may be of advantage if the resolution of the detector does not suffice to distinguish between neighbouring marking elements 11 when the detector is located at a position defined by the housing.

The detector receives light propagating from the marking elements 11, that means, it records at least one picture of the marking elements 11 which may be called the detected information. The control and evaluation unit then processes the detected information to determine whether each marking element 11 does perform a marking operation when activated. If this is not the case, the respective marking element is identified as a defective marking element 12.

In the example shown in FIG. 2, this is the case for the defective marking element 12 of column C3 and row R7.

This type of detection may be of advantage if a control circuit inherently connected to the light sources, such as a diode control circuit, does not detect that a marking element 12 fails.

A further procedure may be provided in which the defective marking element 12 is replaced by one of the spare elements 13. This may be accomplished in that a user, e.g. a service technician, swaps the positions of the defective and the spare element with an adequate hand tool.

After replacement, the order of marking elements 11 may be, again, unknown. In particular, it may be unknown to the control and evaluation unit, which spare element 13 was chosen by a user to replace the defective marking element 12. It may be therefore provided that subsequently the 'pixel order detection mode', as described above, is performed.

Figure 3:
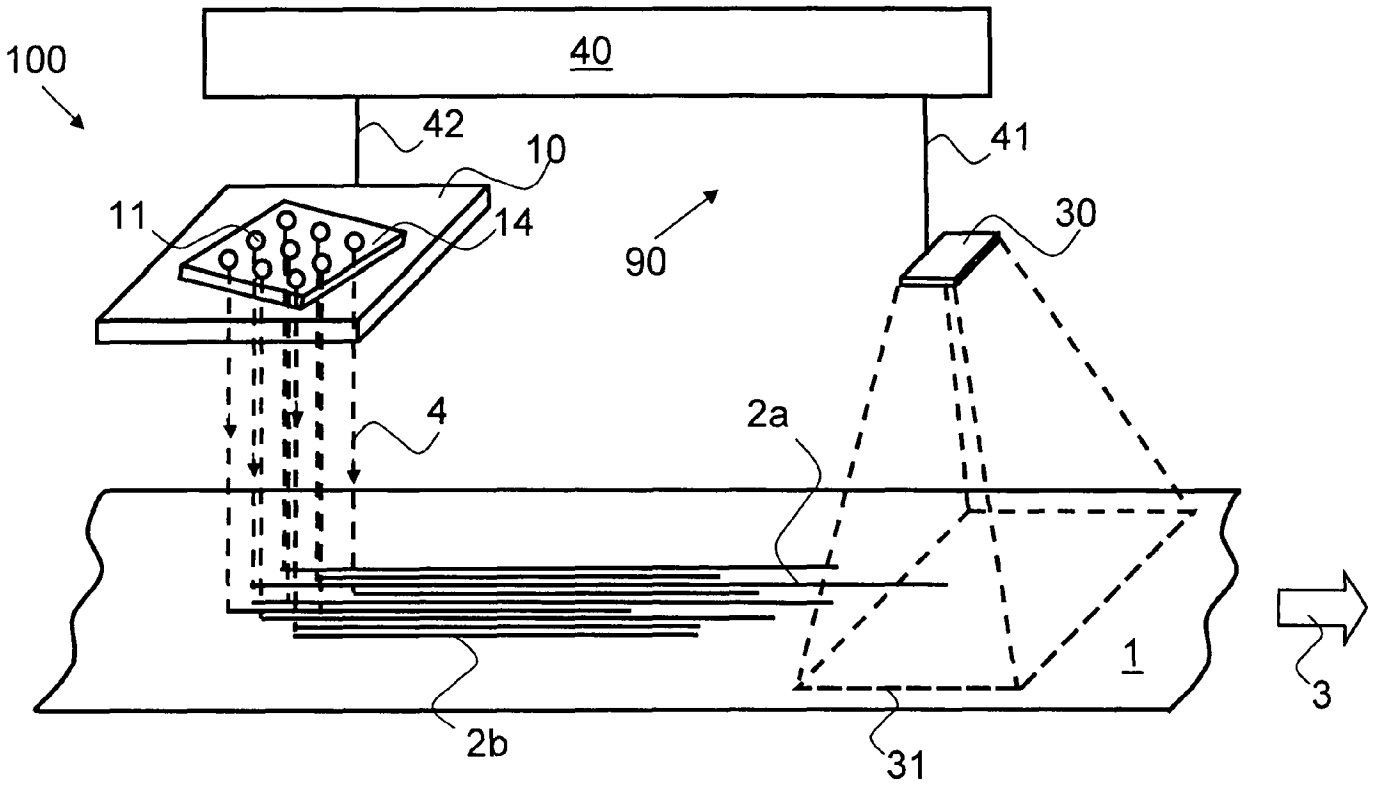
FIG. 3 shows a schematic perspective view of a second embodiment of an inventive apparatus and an inventive monitoring device.

It is thus possible to identify and replace a defective marking element 12 within a few minutes or even less than one minute. Another embodiment of an inventive monitoring device 90 and a marking apparatus 100 according to the invention are shown in FIG. 3.

In this embodiment, the detector 30 detects a marking operation not by measuring marking light 4 but by detecting markings 2*a*, 2*b* applied to an object by the marking elements 11.

To this end, the marking head may be located and driven in a regular operation mode. That means, an object 1 to be marked is moved in a direction of movement 3 or advance direction 3 along the marking head 10. The marking elements 11 are activated by the control and evaluation unit 40 to apply markings 2*a*, 2*b* onto the object 1.

The detector 30 may be arranged neighbouring the marking head 10 in the advance direction 3. As a consequence, the markings 2*a*, 2*b* are moved into a detection area 31 of the detector 30 so that detected information can be recorded.

In the example shown, a first marking 2*a* has already entered the detection area 31 while another marking 2*b* is just about to enter the detection area 31. As the time order of activation of the marking elements 11 is known, and/or as a position of the markings 2*a*, 2*b* can be determined from the detected information, it is possible to allocate a certain marking 2*a*, 2*b* to a respective marking element 11.

For facilitating discrimination between different marking elements 11 on the basis of the markings 2*a*, 2*b* recorded, a time span of activation may be controlled by the control and evaluation unit 40 to be different for each marking element 11. The detected information can then be analyzed in order to determine a time span of activation from each marking 2*a*, 2*b*.

A housing (not depicted) may be provided which substantially extends from the detector 30 to the object 1. As an object 1, it is also possible to use a reference object having a pattern identifiable by the detector 30 for facilitating the evaluation of detected information regarding the markings 2*a*, 2*b*.

Furthermore, also this embodiment allows for carrying out the 'pixel order detection mode' and the 'defective pixel detection mode'.

The embodiments of the monitoring devices and marking apparatuses described herein thus enable an examination of marking elements which may be time effective to carry out while at the same time minimal cost equipment is required for the monitoring device.

The invention claimed is:

1. A monitoring device for monitoring marking elements of a marking head, wherein the marking head comprises an array of receiving spaces, wherein each of the marking elements includes a light source for emitting marking light used for marking and includes a light guide connected to the light source and one of the receiving spaces for guiding the marking light from the light source to the receiving space, the monitoring device comprising:

a detector for recording detected information on the marking, and a control and evaluation unit which is adapted to determine whether the marking elements carry out marking operations based on the detected information, wherein, the detector is a light detector, and the control and evaluation unit is adapted to determine which light source is connected to which receiving space based on the detected information and on activation information about which marking elements were activated when the detected information was recorded.

2. The monitoring device of claim 1, wherein the control and evaluation unit is adapted to determine whether a marking element is defective based on the detected information and on activation information about which marking elements were activated when the detected information was recorded.

3. The monitoring device of claim 1, wherein the detector provides for spatially resolved recording of detected information on the marking elements with a camera.

4. The monitoring device of claim 1, wherein the control and evaluation unit is adapted for activating the marking elements to carry out marking operations in a predefined order.

5. The monitoring device of claim 1, wherein a housing for holding the detector in a defined position relative to the marking head is provided.

6. The monitoring device of claim 5, wherein the housing is formed to prevent stray light from reaching the detector.

7. The monitoring device of claim 5, wherein fixing means for removably fixing the housing to the marking head in a defined relative position is provided.

8. The monitoring device of claim 1, wherein an at least partially transparent plate is provided at the housing.

9. The monitoring device of claim 8, wherein the at least partially transparent plate is a phosphorescent or fluorescent plate.

10. A marking apparatus comprising:

a marking head; and the monitoring device of claim 1.

11. The apparatus of claim 10, wherein the marking head comprises at least one spare element for marking, the at least one spare element is deactivated if all marking elements are functional, and the at least one spare element is displaceable in order to replace a defective marking element.

12. A method for monitoring marking elements of a marking head with the monitoring device of claim 1, the method comprising:

activating the marking elements to carry out marking operation that produce markings on an object, recording detected information on the markings produced by the marking elements, and determining whether a marking element carries out a marking operation based on the detected information on the produced markings.

13. The method of claim 12, wherein in order to detect whether a marking element is defective:

activating the marking elements all at once, recording detected information on all marking elements at once, and if one marking element does not carry out a marking operation, identifying this marking element as a defective marking element.

14. The method of claim 12, wherein for determining an order of the marking elements:

activating the marking elements successively, determining a position of the respective activated marking element, and building a mapping table comprising the positions of the marking elements.

15. The method of claim 12, wherein for replacing a defective marking element in the marking elements of the marking head, at least the following steps are carried out:

identifying the defective marking element of the marking head based on the detected information, and replacing the defective marking element with a spare element.

* * * * *